US006111966A

United States Patent [19]

Staat et al.

[11] Patent Number: 6,111,966

[45] Date of Patent: Aug. 29, 2000

[54] CAPACITOR MICROPHONE

[76] Inventors: Raimund Staat, Erdbrandweg 16, 30938 Burgwedel; Claus-Peter Hinke, Eichhornstrasse 3, 31303 Burgdorf, both of Germany

[21] Appl. No.: 09/058,583

[22] Filed: Apr. 10, 1998

[30] Foreign Application Priority Data

Apr. 11, 1997 [DE] Germany ..... 197 15 365

[51] Int. Cl.[7] ..... H04R 25/00

[52] U.S. Cl. ..... 381/174; 381/191; 367/170; 367/181

[58] Field of Search ..... 381/174, 173, 381/170, 190, 191, 91, 356; 367/170, 181, 188

[56] References Cited

U.S. PATENT DOCUMENTS

| | | | |
|---|---|---|---|
| 4,142,073 | 2/1979 | Agneus et al. | 179/111 |
| 4,258,235 | 3/1981 | Watson . | |
| 5,392,358 | 2/1995 | Driver | 381/191 |
| 5,570,428 | 10/1996 | Madaffari et al. | 381/191 |

FOREIGN PATENT DOCUMENTS

| | | |
|---|---|---|
| 0077615 | 9/1982 | European Pat. Off. . |
| 3415088 | 4/1984 | Germany . |
| 582593 | 11/1977 | Russian Federation . |
| 0400629 | 10/1933 | United Kingdom . |
| WO 97/01258 | 1/1997 | WIPO . |

*Primary Examiner*—Curtis A. Kuntz
*Assistant Examiner*—Suhan Ni
*Attorney, Agent, or Firm*—Trask Britt

[57] ABSTRACT

The invention relates to a capacitor microphone having a housing, a first membrane, a backplate electrode associated with this membrane, and an opening through which sound can reach the membrane. It is therefore the task of the invention to provide an effective protection against sweat penetration into the microphone, thus overcoming prior art disadvantages and problems.

16 Claims, 1 Drawing Sheet

CAPACITOR MICROPHONE

BACKGROUND OF THE INVENTION

1. Field of the Invention

The invention relates to a capacitor microphone having a housing, having a first membrane likewise a backplate electrode associated with this membrane, and an opening through which sound can reach the membrane.

2. Description of the Related Art

A known capacitor microphone is of the MKE 2-microphone type by Sennheiser electronic GmbH & Co. This MKE 2-microphone is a permanent polarized capacitor microphone, which as a high grade, small attachable microphone having a diameter of about 4–6 mm, is inserted everywhere where other attachable microphones are too conspicuous due to their greater dimensions. Such very small microphones of the highest quality are used particularly in concert performances, musicals or in other show-business where the artist sings or speaks in addition to the theatrical or dance performance, and the microphone is attached well hidden, to the artist's body, for example in their hair or inside the costume, being correspondingly aligned to the artist's mouth.

The MKE 2 fulfils the highest claims as regards quality of tone and sturdiness, and is suitable for the transmission of speech and instrument pick-up in all areas of live sound transmission technology. The apparatus can be connected directly to apparatus having 12–14 volts phantom power supply, and is relatively non-sensitive to impact sound, and has at its disposal a very linear frequency response, this being very important for a faithful recording.

It can happen in unfavourable circumstances that sweat penetrates the microphone capsule MKE 2 and distorts it, especially if the artist perspires heavily. In this connection one must know that a capacitor microphone is a pressure microphone which is usually insensitive to high atmospheric moisture, as the air exchange with a sensitive electret is itself interrupted through the membrane in front of the back plate electrode. The atmospheric moisture inside the microphone or microphone housing only equates very slowly to the outside atmospheric moisture, as the membrane is vapour-permeable in general. If the microphone capsule is manufactured clean, this is not a problem. Only the penetration of salts, e.g. electrolytic fluids such as are contained in human sweat is critical. They would immediately discharge the electret sheet to the backplate electrode. Both known microphones are of the MKE 2 type, and as with all other capacitor microphones also, an acoustic orifice is provided as a sound passage opening through which the incoming sound arrives in an outer area inside the microphone and finally strikes the membrane. The membrane is arranged on a membrane ring, and the sweat cannot force past the membrane ring itself as it is located in a silicone seal.

The sweat is subsequently sucked through a very small hole (opening) having a diameter of only 10–30 $\mu$m and which is arranged in the membrane in the critical air gap between the membrane and the backplate electrode. This leads to the discharge of the electret sheet. The above-named small membrane opening is provided with capacitor microphones for equalising pressure, so that the membrane does not "cling" to the backplate electrode on air pressure oscillations, which can lead to damage on the one hand, and on the other, to undesired receiving noises. Independent of the small membrane opening location, it can hardly be avoided that at some point, sweat will arrive in the air gap between the membrane and the backplate electrode, and lead to the discharge of the electret sheet.

The sweat problem has been known for a long time and has until now been fought against, for example in that a preferably water-repellent, vapour and sound permeable polyester fleece is arranged in front of the microphone housing acoustic opening. In addition the whole microphone capsule together with the soldering joints are hermetically sprayed so as to avoid sweat penetration to other parts of the microphone as well.

However, it has been shown that in spite of the above measures, no completely reliable sweat deflection is possible inside the microphone, as sweat arrives in the capacitor microphone time and again in unfavourable circumstances, and can lead to a microphone cut-out. Above all, the known materials introduced into the microphone capsule or the membrane are repellent as regards distilled water. However, after a certain time, they permit sweat to penetrate due to its small surface tension, and thus do not fulfil the desired requirements, which in the worst case could lead to a complete microphone cut-out.

SUMMARY OF THE INVENTION

Therefore the task of the present invention is to provide an effective protection against sweat penetration into the microphone, thus overcoming the above-described disadvantages and problems.

According to the invention, a capacitor microphone is suggested having the features according to claim 1. One is here concerned with a capacitor microphone having a microphone housing within which a first membrane and a backplate electrode associated with same are arranged in proximity to one another, likewise an opening through which sound waves arrive at the membrane, and further a membrane ring are arranged, on one side of which the first membrane is located, and a second membrane which is located on the other side of the membrane ring.

Contrary to an open pore, sound-permeable fleece, the second membrane is completely closed so that the problem of moisture appearing in the critical air gap between the first membrane and the backplate electrode no longer happens, as, due to the seal of the second membrane, a protective wall is constructed through this in front of the first membrane to some degree. In addition, the second membrane does not possess any pressure equalization due to a lack of opening, as the first membrane does. The second membrane has sufficient space to follow the static air pressure oscillations. The first membrane can retain its equalization opening and remains with static air pressure oscillations in the defined rest position at a distance of 10–20 m in front of the backplate electrode.

The double membrane created by the invention has approximately the same electrostatic properties as the first membrane alone, if the second membrane is essentially lighter in weight and is weaker tensioned than the first membrane. Ratios of 1:4 are attainable and have proved to be a good compromise. In this connection, the second membrane can preferably be stamped. Both membranes of the double membrane system swing rigidly coupled in the whole transmission area, so that no additional resonances arise if the distance between the membranes is small. Ideally this is achieved in that the second membrane is located directly in front of the membrane ring, whilst the first membrane is located directly behind the membrane ring, and thus the membrane ring ensures a constant distance between the two membranes. From the finished point of view it is additionally very favourable if the two membranes are adhered to opposingly located sides of the membrane ring, instead of the second membrane being adhered in the microphone capsule housing.

A moisture-repellent cap can be placed on the microphone capsule for further protection from sweat penetration, which is available for example as a teflon coating. Finally it can also be advantageous to mount corresponding covering material in this area or laterally to the microphone capsule, to protect the rear microphone area where the microphone contacts are connected to the cable, so as to prevent sweat penetration into the microphone at these points. Tests with covering materials such as silicone rubber, polyester or the use of three-component adhesives or also SMD-adhesive materials have led to very good results, and a very good seal for the microphone in the rear area could be achieved with these materials.

BRIEF DESCRIPTION OF THE DRAWINGS

The invention will now be described by way of example with the aid of the accompanying drawings.

DETAILED DESCRIPTION OF THE PREFERRED EMBODIMENT

Figure 1:
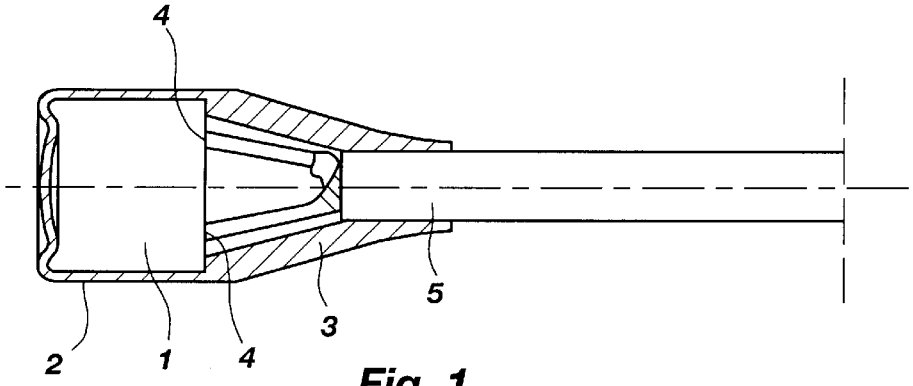
FIG. 1 shows a cross-section through an inventive capacitor microphone substantially on a scale of 10:1.

FIG. 1 shows a capacitor microphone capsule 1 in cross-section according to the invention with a housing 2, which is located within a shrinkage part 3, which encompasses both the microphone capsule 1 and its contacts 4, likewise a part of the cable 5 attached to contacts 4. Furthermore the microphone capsule and the cable are adhered to the shrinkage part, and whereby for example an SMD-adhesive or a two-component adhesive is used as the adhesive so that no sweat can penetrate into the rear area or lateral area of the microphone capsule from outside. It is obvious that all measurements in FIG. 1 and also in FIG. 2 are only by way of example, and that the invention is in no way restricted to a microphone capsule or a microphone of the shown measurements.

Figure 2:
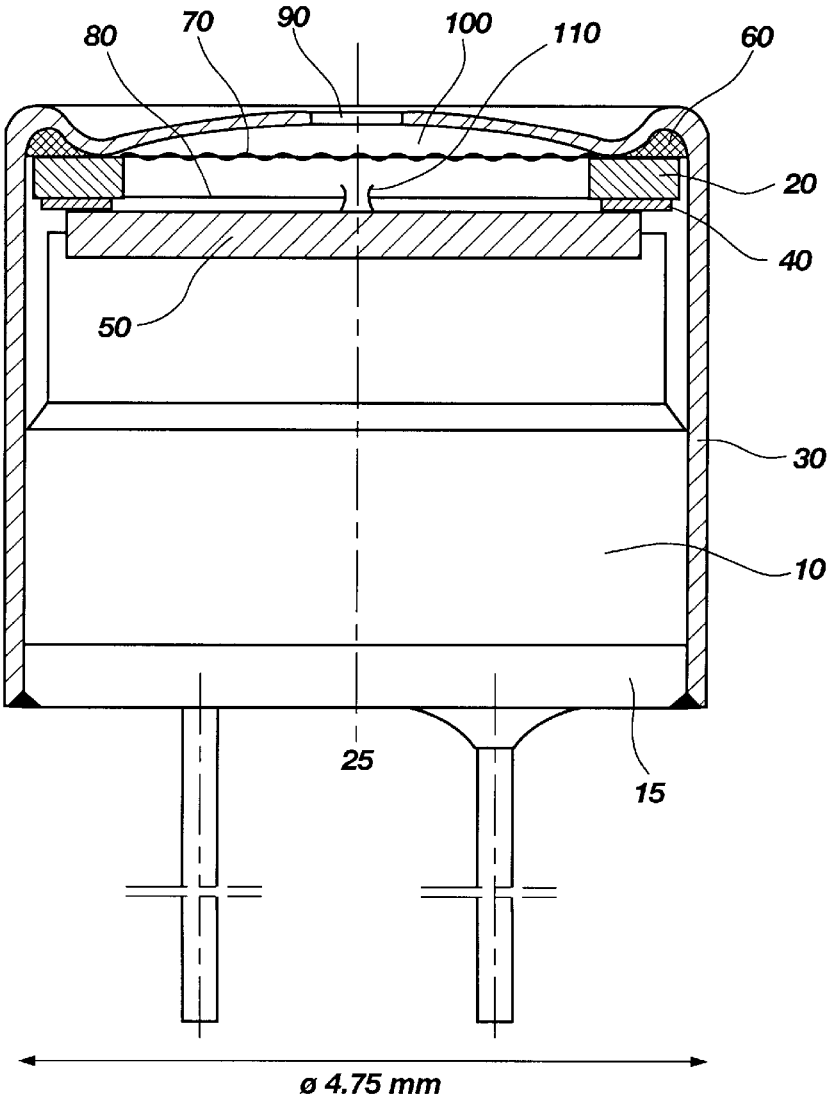
FIG. 2 shows a cross-section through a capacitor microphone having a shrinkage part substantially on a scale of 5:1.

FIG. 2 shows an inventive microphone capsule 10 in cross-section on a scale 10:1 with a housing 30 which is connected to a contact plate 15 by means of laser welding for example. In the forward area of the microphone capsule, housing 30 has a sound inlet opening 90—also called an acoustic orifice, through which sound can arrive in the inner forward space of the microphone capsule. In the forward housing area, this is pulled downwards on the edge towards the inside of the microphone, and the housing is shaped cross-sectionally slightly convex towards central axis 25, and where sound inlet opening 90 is let into the centre of the outer, forward housing area as a circular hole. A silicone seal 60 is located inside in the edge area of the housing, for example as a ring. Forward space 100 is defined by a second membrane 70. This membrane is located on the forward side of a membrane ring 20, on whose rear side the first membrane 80 is arranged. Preferably both the second and the first membrane are adhered to the membrane ring.

The second membrane is completely closed, whilst the first membrane has a very small opening of only 10–30 mm in the central area. A spacing ring 40 adjoins the first membrane 80 which only has a thickness of about 10 $\mu$m and serves as a spacer from backplate electrode 50, which likewise abuts with spacing ring 40. It is possible that the thickness of the spacing ring oscillates between 10 and 50 $\mu$m and thus provides for a corresponding spacing of backplate electrode 50 from the first membrane 80. The small opening 110 serves as pressure equalization, so that on air pressure oscillations the first membrane 80 does not cling to backplate electrode 50, which can lead to reception impairments, damage or even distortion of the microphone capsule. A not-shown electret sheet is arranged on the backplate electrode as an electret layer.

The thickness ratio of the first to the second membrane can for example lie in the region of about 3–4:1. In this connection, the absolute thickness of the second membrane can amount to 1$\mu$m.

Due to the lack of an opening, second membrane 70 does not possess any pressure equalization. However, it has sufficient space to follow the static air pressure oscillations. The first and second membranes form a double membrane, and possess substantially the same properties as the first membrane 80 on its own as a result of their adjustment, if second membrane 70, as described above, is essentially lighter and weaker tensioned than first membrane 80. The second membrane 70 can be stamped.

The membranes of the double membrane system swing rigidly coupled in the whole transmission area, so that no additional resonances arise if the distance between the membranes is small.

From the finished point of view it is very favourable if both membranes are adhered to membrane ring 20, instead of the second membrane 70 being adhered in the capsule housing 30.

It is obvious that the microphone capsule can be provided with an external cap, which is available as further sound-permeating layers e.g. fleece, or which has a moisture-repellent layer, e.g. a teflon coating. Also advisable for many reasons is for the cap to have a gauze so as to avoid penetration by coarse particles into the microphone outer area.

In tests it can be confirmed that the double membrane system on the one hand hinders the penetration of sweat in the region of first membrane 80 or in the space between first membrane 80 and backplate electrode 50, and on the other hand the microphone subsequently as previously fulfils the highest claims as regards quality of tone and sturdiness, and in addition has an almost linear frequency response, as does the known MKE 2 also.

The described and represented microphone has an omnidirectional characteristic available over a transmission range of 20–20,000 Hz, likewise over a free field open circuit transmission ratio (1 KHz) of 10 mV/pa+–2.5 dB. The nominal impedance amounts to 50 Ohm and the connecting-closing impedance amounts to 1000 Ohm. The replacement noise level (IEC 651) amounted to 27 dB with an A-evaluation, to 38 dB with a CCIR (CCIR 4683)-evaluation. The limiting acoustic pressure level amounted to 100–130 dB with a frequency of 1 KHz (non-linear distortion factor about 1%), and to about 6 mA with the feed current. The total microphone capsule weight amounts to about 1 g (!).

With live transmission of musicals or live concerts of groups, the inventive attachable microphones are worn over the head on the forehead or in the hair. As a result of this, sweat can penetrate both forwards into the microphone—where only sound should enter—and also into the rear area of the electrical connections of the microphone capsule. For example sweat can arrive along the cable directly under the anti-kink to the microphone capsule electrical connections, and can short-circuit the microphone output signal there.

The normally sprayed anti-kink is not sealed to either the cable cover or the microphone capsule housing, and can be easily infiltrated by sweat. It is suggested to firstly apply a sealing compound to the microphone capsule electrical connections. This sealing compound should adhere to metal, soldering tin, which still has welding flux residue or insulating components, and seals particularly well with the individual to-be-connected cable leads. Material which is suitable for one such sealing compound such as is used in electronics e.g. for covering hybrid circuits can be used. Sealing compound materials which are advantageous are two-component polyurethane casting resin, two-component epoxy-casting resin, Silicone rubber or single-component epoxy-casting resin, which are also used for adhering SMD parts before the wave soldering.

After application of the sealing compound, the microphone capsule is encased as a whole with its connections and the start of the cable cover. In addition, adhesion can offer particular security against downward creeping as a result of sweat. Finally the shrinkage hose—here FIG. 1—is provided internally with hot-melt-type adhesive. In the shrinkage process itself the adhesive is also activated, which hardens after cooling. It can also be suitable to adhere rubber grommets, e.g. made from neoprene, ideally for example with loktite 480 cyan acrylate, having the rubber component to the cable cover made from polyurethane.

Finally, a suitable selection of spray material for cable anti-kink protection can also prevent sweat from penetrating from behind into the rear part of the microphone capsule. The spray material should lightly loosen the cable cover, and an elastic, thermoplastic polyester has been proved to be suitable for a polyurethane cable cover.

A water-repellent screen serves as additional protection for the forward microphone area, which is arranged in front of the sound inlet opening. The use of fleece material e.g. goretex, is better than previous polyester fabric.

What is claimed is:

1. A capacitor microphone comprising:

a microphone housing;

a first membrane located within said microphone housing, said first membrane having a sound inlet opening;

a backplate electrode associated with said first membrane and spaced therefrom at a small distance;

a membrane ring having first and second sides, on the first side of which said first membrane is located; and a second membrane positioned on the second side of the membrane ring, said second membrane having no means for pressure equalization.

2. A capacitor microphone according to claim 1, characterized in that the first membrane is found in the rest position at a distance of about 10 to 50 $\mu$m in front of the backplate electrode.

3. A capacitor microphone according to claim 2, further characterized in that the second membrane is essentially lighter than the first membrane.

4. A capacitor microphone according to claim 2, characterized in that the weight ratio or tension/rigidity ratio of the first membrane to the second membrane amounts to about 4:1.

5. A capacitor microphone according to claim 2, characterized in that both the first and the second membrane are adhered to the membrane ring.

6. The capacitor microphone of claim 2, wherein the second membrane is weaker tensioned than the first membrane.

7. The capacitor microphone of claim 6, wherein the weight ratio or tension/rigidity ratio of the first membrane to the second membrane is about 4:1.

8. The capacitor microphone of claim 6, wherein both the first and the second membrane are adhered to one membrane ring.

9. A capacitor microphone according to claim 1, characterized in that the second membrane is essentially lighter than the first membrane.

10. A capacitor microphone according to claim 9, characterized in that the weight ratio or tension/rigidity ratio of the first membrane to the second membrane amounts to about 4:1.

11. A capacitor microphone according to claim 9, characterized in that both the first and the second membrane are adhered to the membrane ring.

12. A capacitor microphone according to claim 1, characterized in that the weight ratio or tension/rigidity ratio of the first membrane to the second membrane amounts to about 4:1.

13. A capacitor microphone according to claim 12, characterized in that both the first and the second membrane are adhered to the membrane ring.

14. A capacitor microphone according to claim 1, characterized in that both the first and the second membrane are adhered to membrane ring.

15. A capacitor microphone according to claim 1, characterized in that the second membrane is weaker tensioned than the first membrane.

16. A capacitor microphone according to claim 1, characterized in that both the first and the second membrane are adhered to membrane ring.

* * * * *